United States Patent [19]

Vasilantone

[11] 4,295,826

[45] Oct. 20, 1981

[54] INFRARED DRYER

[76] Inventor: Michael Vasilantone, 34 Columbia Rd., Somerville, N.J. 08876

[21] Appl. No.: 161,488

[22] Filed: Jun. 20, 1980

[51] Int. Cl.[3] ..... F27B 17/00; F26B 19/00

[52] U.S. Cl. ..... 432/185; 34/223; 34/224; 34/233; 432/175; 432/222; 432/233

[58] Field of Search ..... 432/185, 233, 175, 222; 34/223, 224, 233, 234

[56] References Cited

U.S. PATENT DOCUMENTS 1,294,269 2/1919 Hopkins ..... 34/234 X 1,935,499 11/1933 Boekel ..... 34/233 X

*Primary Examiner*—John J. Gamby

*Attorney, Agent, or Firm*—Baker & McKenzie

[57] ABSTRACT

Disclosed is an infrared dryer which comprises (1) at least one infrared heater in a heating chamber, (2) a pair of mutually parallel air troughs which guide ambient air from an intake end of the dryer, along the top of the dryer, and empty air into a collector box of the air plenum at the downstream end of the dryer, (3) a header disposed above the heating chamber and ported to permit air from the header to be directed onto objects in the heating chamber, and (4) means for recirculating air from the heating chamber into the header.

28 Claims, 6 Drawing Figures

FIG. 4
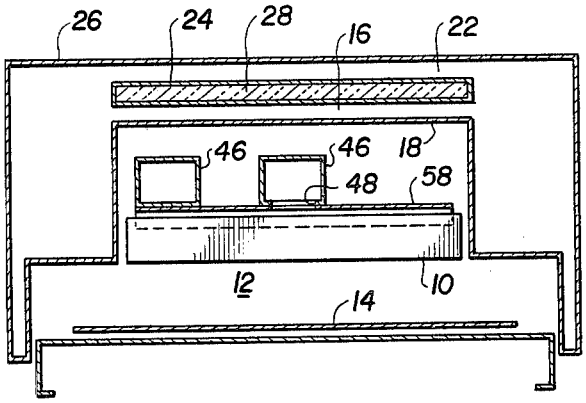
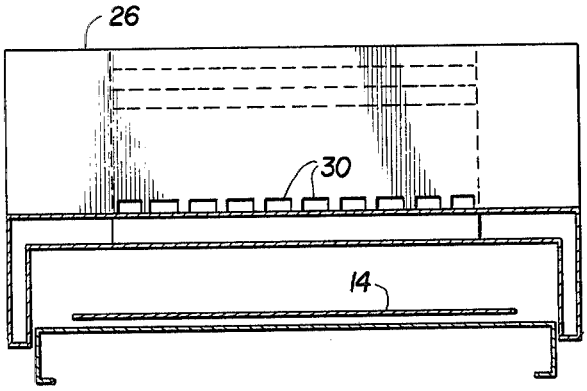
FIG. 5
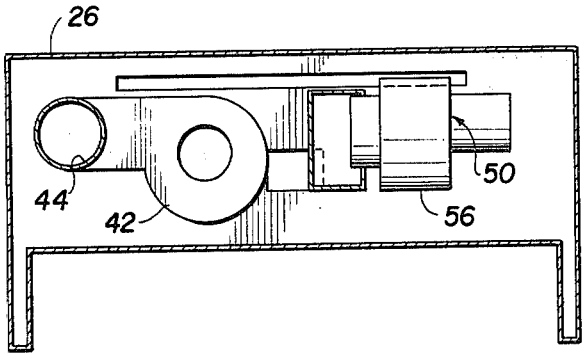
FIG. 6

INFRARED DRYER

TECHNICAL FIELD

This invention relates to infrared dryers such as are used to dry freshly painted objects.

BACKGROUND OF THE PRIOR ART

This invention is an improvement upon the invention disclosed in my prior application Ser. No. 951,222, filed Oct. 13, 1978, now U.S. Pat. No. 4,209,294, issued June 24, 1980.

BRIEF SUMMARY OF THE INVENTION

The subject invention is a heating device which comprises (1) at least one heater in a heating chamber, (2) a pair of air troughs, one upper and one lower, which guide ambient air from an intake end of the heating device, along the top of the heating device, and empty air into a collector box at the downstream end of the heating device, (3) a header disposed above the heating chamber and ported to permit air from the heater to be directed onto objects in the heating chamber, and (4) means for recirculating air from the heating chamber into the header.

BRIEF DESCRIPTION OF THE DRAWINGS

FIG. 4 is a transverse sectional view taken along the line 4—4 in FIG. 1.

FIG. 5 is a transverse sectional view taken along the line 5—5 in FIG. 1.

FIG. 6 is a transverse sectional view taken along the line 6—6 in FIG. 1.

DETAILED DESCRIPTION OF THE PRESENTLY PREFERRED EMBODIMENT

Figure 1:
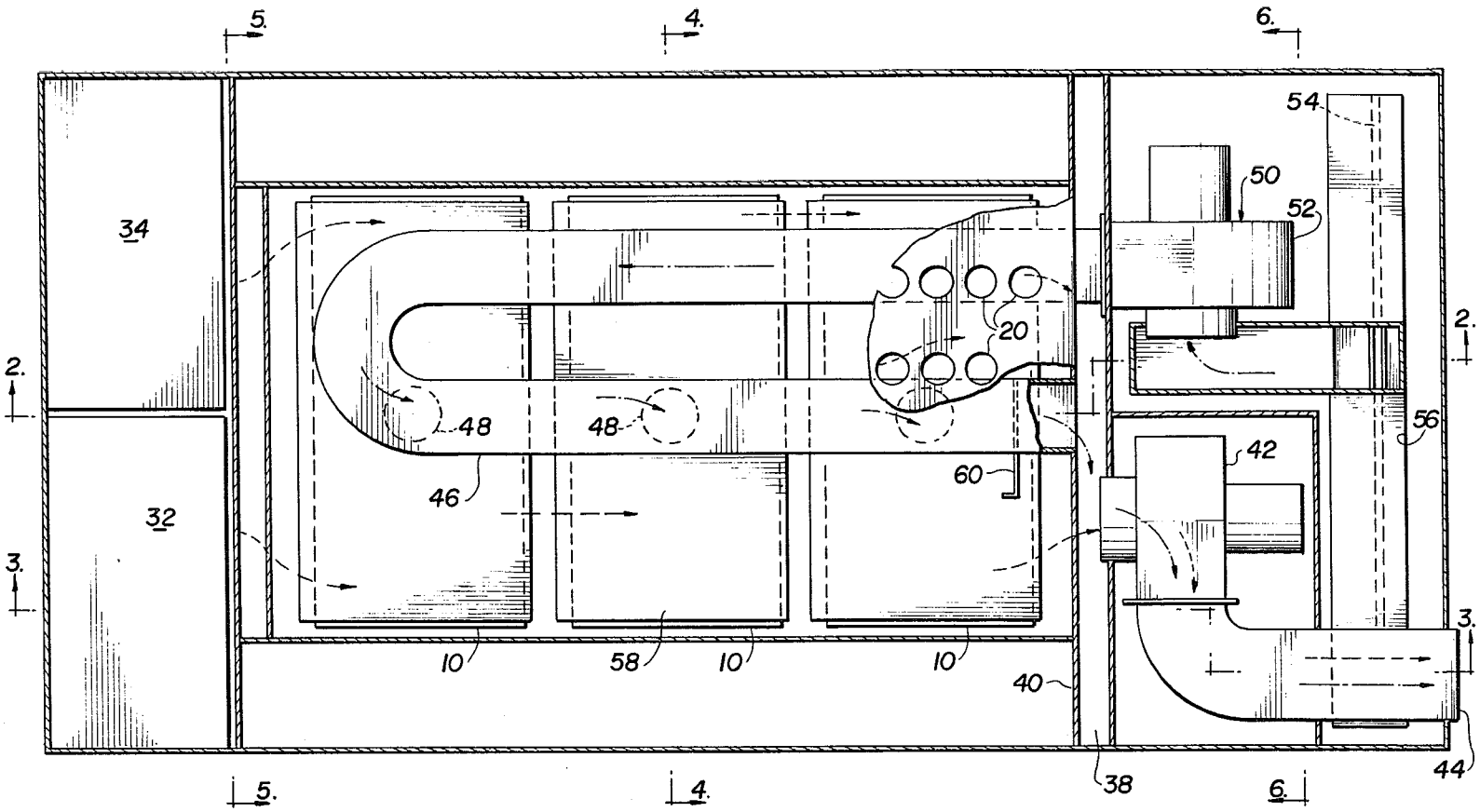
FIG. 1 is a plan view, partly broken away, of the presently preferred embodiment of the subject invention.

The infrared dryer shown in the drawings comprises a plurality of infrared heaters 10 mounted in a heating chamber 12 in which objects (not shown) carried on an endless conveyor 14 are to be exposed to heat in order to dry them. A first air trough 16 defined by a first air trough plate 18 disposed above the heating chamber 12 is ported at 20 to accept effluent air from the heating chamber 12. A second air trough 22 defined by a second air trough plate 24 is disposed above the first air trough 16, extends along the upper surface or cover 26 of the dryer, and serves to continually cool the upper surface or cover 26. A layer of insulation 28 is disposed between the first and second air troughs 16 and 22 to shield the flow of cooler ambient air passing through the second air trough 22 from the relatively hot mixed air passing through the first air trough 16.

Figure 3:
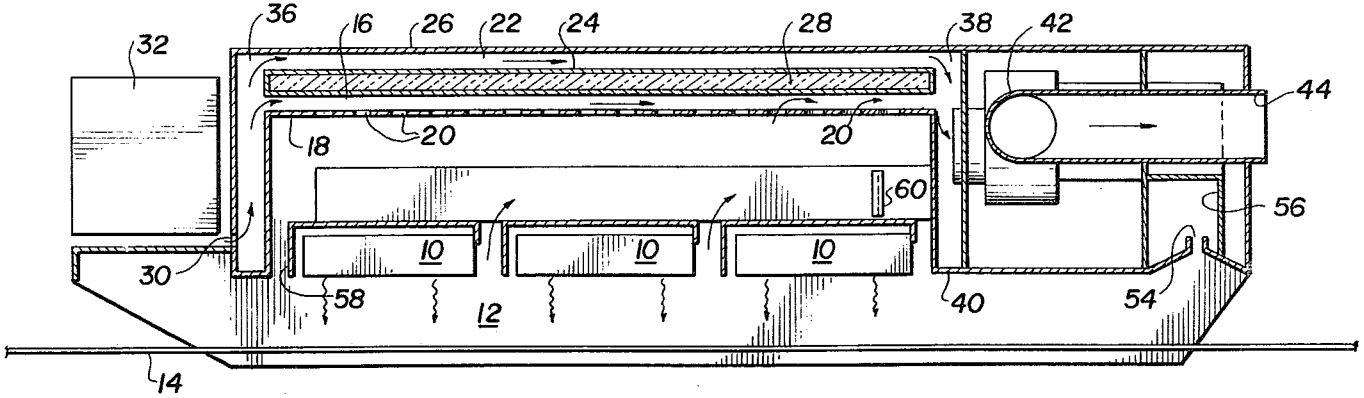
FIG. 3 is a longitudinal sectional view taken along the line 3—3 in FIG. 1.

Ambient air enters the dryer through a plurality of inlets 30 adjacent to a control box 32 and a junction box 34. The inlets 30 lead to a secondary, or metering, air box 36. From the secondary air box 36, the ambient air splits. The greater part goes into the first air trough 16, where it mixes with effluent air from the heating chamber 12 which, as illustrated in FIG. 3, has passed around the infrared heater 10 and through the ports 20 into the first air trough 16. The lesser part goes into the second air trough 22, where it cools the upper surface or cover 26 of the dryer, as previously explained. At the downstream end of the first and second air troughs 16 and 22, the air from those troughs is reunited in a primary, or collector, air box 38 located in an air plenum 40. From the primary air box 38, all of the air is drawn through an exhaust blower 42 and exits the dryer via outlet 44.

Figure 2:
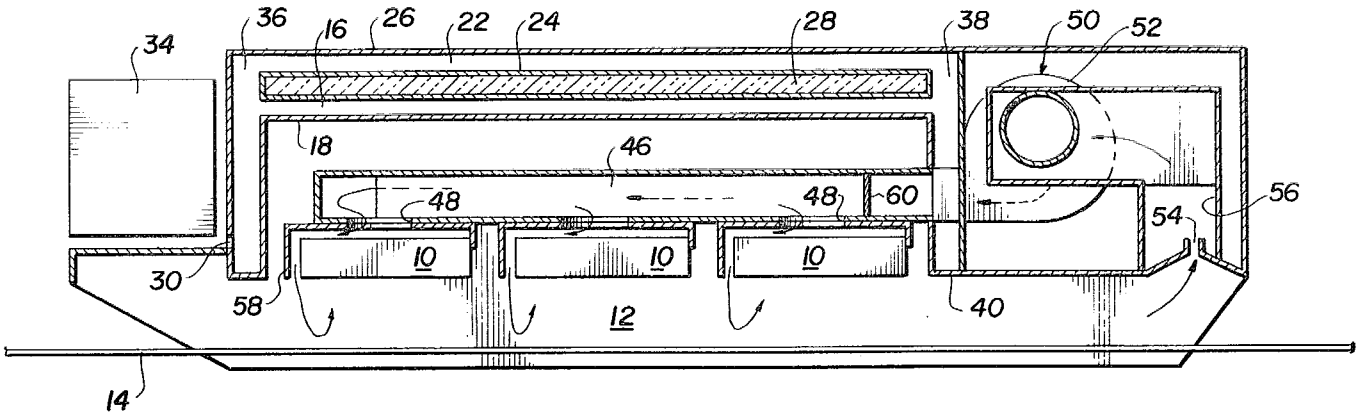
FIG. 2 is a longitudinal sectional view taken along the line 2—2 in FIG. 1.

A header 46 is disposed above the heating chamber 12. The header 46 is ported at 48 to permit air from the header 46 to be diverted onto the objects to be dried, providing a uniform mixture of heated air and infrared heat. Means 50 are provided for recirculating air from the heating chamber 12 into the header 46. In the illustrated embodiment, the means 50 comprise a recirculating blower 52, a slot 54 across the top of the heating chamber 12 near its downstream end, and a suction air box 56. The heaters 10 are mounted in shrouds 58 which, as illustrated in FIGS. 2 and 4, are in fluid communication with the header 46 such that air from the header 46 passes between the heaters 10 and the shrouds 58 and is directed downwardly in transverse curtains on objects being dried. As shown in FIG. 1, air from the header 46 which does not pass downwardly through the ports 48 passes into the collector air box 38, where it joins air from the first and second air troughs 16 and 22 and is vented by the exhaust blower 42.

An adjustable gate 60 is provided at the end of the header 46. Operation of the adjustable gate 60 controls the amount of air delivered to the heating chamber 12 from the header 46. The shrouds 58 act as heat sinks to both cool and preserve the heaters 10, utilizing the heat drawn off the heaters 10 to pre-heat the recirculated air without the use of additional energy.

As will be apparent, the heating device disclosed herein is similar to the heating device disclosed in my prior application Ser. No. 951,222, filed Oct. 13, 1978, now Pat. No. 4,209,294 issued June 24, 1980. It differs, however, in two major respects.

First, the baffle 30 with its apertures 32 have been eliminated from the blower design. Instead, the heaters 10 act as a baffle, and the spaces between the heaters act as exhaust apertures.

Second, a recirculating air system has been added in order to deliver pre-heated air to the heating chamber 12. In this manner, objects passing through the heating chamber can be subjected to additional air scrubbing for heat uniformity. This is particularly important for the drying of water-based inks, since scrubbing, or air agitation, accelerates the removal of heavy solvents such as water and the like.

CAVEAT

While the present invention has been illustrated by a detailed description of a preferred embodiment thereof, it will be obvious to those skilled in the art that various changes in form and detail can be made therein without departing for the true scope of the invention. For that reason, the invention must be measured by the claims appended hereto and not by the foregoing preferred embodiment.

What is claimed is:

1. A heating device comprising:

(a) a heating chamber in which objects are to be exposed to heat;

(b) at least one heater in said heating chamber;

(c) a first air trough disposed above said heating chamber;

(d) first means of fluid communication for communicating effluent air from said heating chamber to said first air trough;

(e) a second air trough disposed above said first air trough, extending along the upper surface or cover of the heating device, and serving to continually cool the upper surface or cover of the heating device;

(f) a header disposed above said heating chamber, said header being ported to permit air from said header to be directed onto the objects to be exposed to heat; and (g) second means for recirculating air from said heating chamber into said header.

2. A heating device as recited in claim 1 and further comprising a blower in fluid communication with said first and second air troughs for moving air therethrough.

3. A heating device as recited in claim 1 wherein said second means comprises a blower in fluid communication with said header and said heating chamber for moving air therethrough.

4. A heating device as recited in claim 1 and further comprising third means for moving ambient air through said second air trough.

5. A heating device as recited in claims 1 or 4 and further comprising fourth means for moving ambient air through said first air trough.

6. A heating device as recited in claim 1 wherein said first and second air troughs are mutually parallel.

7. A heating device as recited in claim 1 wherein said header and said first and second air troughs are mutually parallel.

8. A heating device as recited in claim 1 and further comprising a secondary air box disposed upstream of and in fluid communication with both said first and second air troughs.

9. A heating device as recited in claim 1 comprising a plurality of heaters disposed in said heating chamber.

10. A heating device as recited in claim 1 and further comprising a shroud in which said heater is mounted, said shroud being in fluid communication with said header such that air from said header passes between said heater and said shroud.

11. A heating device as recited in claim 1 wherein said heater is an infrared heater.

12. A heating device as recited in claim 1 wherein said device is a dryer and objects are dried in said heating chamber.

13. A heating device as recited in claim 1 and further comprising a primary air box disposed downstream of and in fluid communication with both said first and second air troughs.

14. A heating device as recited in claim 1 and further comprising an adjustable gate disposed in said header to control the amount of air delivered to said heating chamber from said header.

15. A heating device having an intake end, a downstream end, and a top, said heating device comprising:

(a) a heating chamber containing at least one heater;

(b) a pair of air troughs which guide ambient air from the intake end of the heating device, along the top of the heating device, and empty air into a collector box located in an exhaust plenum at the downstream end of the heating device, one of said air troughs running along the top of the heating device and being ported to accept effluent air from said heating chamber and the other of said air troughs extending along the upper surface of the heating device and serving to continually cool the top of the heating device;

(c) a header disposed above said heating chamber, said header being ported to permit air from said header to be directed onto the objects to be exposed to heat; and (d) first means for recirculating air from said heating chamber into said header.

16. A heating device as recited in claim 15 and further comprising a blower in fluid communication with said first and second air troughs for moving air therethrough.

17. A heating device as recited in claim 15 wherein said first means comprises a blower in fluid communication with said header and said heating chamber for moving air therethrough.

18. A heating device as recited in claim 15 and further comprising second means for moving ambient air through said second air trough.

19. A heating device as recited in claims 15 or 18 and further comprising third means for moving ambient air through said first air trough.

20. A heating device as recited in claim 15 wherein said first and second air troughs are mutually parallel.

21. A heating device as recited in claim 15 wherein said header and said first and second air troughs are mutually parallel.

22. A heating device as recited in claim 15 and further comprising a secondary air box disposed upstream of and in fluid communication with both said first and second air troughs.

23. A heating device as recited in claim 15 comprising a plurality of heaters disposed in said heating chamber.

24. A heating device as recited in claim 15 and further comprising a shroud in which said heater is mounted, said shroud being in fluid communication with said header such that air from said header passes between said heater and said shroud.

25. A heating device as recited in claim 15 wherein said heater is an infrared heater.

26. A heating device as recited in claim 16 wherein said device is a dryer and objects are dried in said heating chamber.

27. A heating device as recited in claim 15 and further comprising a primary air box disposed downstream of and in fluid communication with both said first and second air troughs.

28. A heating device as recited in claim 15 and further comprising an adjustable gate disposed in said header to control the amount of air delivered to said heating chamber from said header.

* * * * *